US005597247A

United States Patent [19]

Inakoshi et al.

[11] Patent Number: 5,597,247

[45] Date of Patent: Jan. 28, 1997

[54] TAPE CARTRIDGE FOR USE IN A TAPE PRINTER

[75] Inventors: Daisuke Inakoshi; Hideo Sodeyama, both of Nagano, Japan

[73] Assignees: Seiko Epson Corporation, Chiba; King Jim Co., Ltd., Tokyo, both of Japan

[21] Appl. No.: 357,126

[22] Filed: Dec. 15, 1994

[51] Int. Cl.[6] ..... B41J 35/28

[52] U.S. Cl. ..... 400/207; 400/208; 242/347.2

[58] Field of Search ..... 400/207, 208, 400/208.1; 242/347.2, 347.1

[56] References Cited

U.S. PATENT DOCUMENTS

| | | | |
|---|---|---|---|
| 3,642,228 | 2/1972 | Tollkuhn | 242/347.2 |
| 4,457,473 | 7/1984 | Mroz et al. | 242/347.2 |
| 4,533,969 | 8/1985 | Miyashita et al. | 360/132 |
| 4,635,155 | 1/1987 | Georgen et al. | 242/347.1 |
| 5,276,080 | 1/1994 | Oku | 524/432 |
| 5,300,999 | 4/1994 | Koh et al. | 355/289 |
| 5,350,243 | 9/1994 | Ichinomiya et al. | 400/208 |
| 5,383,733 | 1/1995 | Zinsmeyer et al. | 400/208 |

*Primary Examiner*—Edgar S. Burr
*Assistant Examiner*—Anthony H. Nguyen
*Attorney, Agent, or Firm*—Loeb & Loeb LLP

[57] ABSTRACT

A tape and/or ink ribbon cartridge releasably insertable into an inserting section of a tape printer has ink ribbon supplying and recovering sections in a casing of the cartridge and an ink ribbon path extending from the ink ribbon supplying section to the ink ribbon recovery section through a printing position. The ink ribbon path has a portion defined by first and a second side walls facing with each other across a constant gap. The first side wall has an opening formed therein. A shutter portion is formed for closing the opening when the upper and lower casing parts are assembled to constitute the casing of the cartridge. One of the side walls which faces to the ink surface of the ink ribbon has a wavy surface. With the opening formed in the side wall, the ink ribbon can easily be inserted in the narrow path between the first and second walls. Since the wavy surface is formed on the side wall, the ink ribbon is prevented from sticking on the side wall.

13 Claims, 6 Drawing Sheets

TAPE CARTRIDGE FOR USE IN A TAPE PRINTER

BACKGROUND OF THE INVENTION

1. Field of the Invention

The present invention generally relates to a tape cartridge or a ribbon cartridge for use in printers such as tape printers and the like. In particular, the present invention pertains to a printer tape cartridge or a ribbon cartridge capable of avoiding degradation of ink ribbon placement workability, ease of ink ribbon transfer and other problems which may accompany printer downsizing.

2. Prior Art

In conventional printers, there are known printers which print a series of desired letters on a surface of a tape having on its back side an adhesive layer covered by a release paper, and thereafter cut the tape so that a label of a desired length can be obtained. In the present specification, this type of printer is referred to as a "tape printer". Printers of this type are used to readily obtain a label having desired letters, marks and the like printed thereon, and therefore it has been widely utilized domestically and in small-sized offices.

Such a tape printer is usually provided with a printing head of the thermal transfer type to facilitate downsizing of the printer. For the same reason, the tape printer is commonly provided with a transfer mechanism which transfers a tape or an ink ribbon in one direction passing through the printing head in a settled position to thereby carry out a printing operation.

The tape or ink ribbon provided for the tape printer is prepared in the form of a cartridge configuration capable of being releasably inserted into the main body of the printer, so that after the tape or ink ribbon runs out, the cartridge as a whole is replaced by a new one. In the present specification, a cartridge for a tape printer which holds both a tape and an ink ribbon therein is referred to as a "tape cartridge", so as to distinguish from an ink ribbon cartridge which holds only an ink ribbon therein and is utilized for commonly used printers.

The tape cartridge used for the conventional tape printer of the thermal transfer type has a main body case comprised by an upper casing part and a lower casing part in which a tape supplying section and a ribbon supplying section are accommodated. The tape and the ribbon dispensed from these sections are guided so that they are superposed at a position where a platen roll defining a printing position is placed. The tape, after being printed, is discharged outside from a tape exit formed in a case side wall, while the ink ribbon is wound at an ink ribbon recovery portion provided in the case. Paths for transferring the tape and the ink ribbon as mentioned above are defined mainly by inner surfaces of side walls of the case.

On the other hand, the tape printer is formed therein with a tape cartridge inserting section, into which the tape cartridge is releasably inserted. At the tape cartridge inserting section, there are provided a printing head mechanism, an ink ribbon winding drive shaft and the like. In an inserted condition of the tape cartridge, these portions are inserted into a printing head receiving portion and other portions formed in the tape cartridge side, so that the tape and the ink ribbon can be controllably transferred from the side of the tape printer, and at the same time the printing head is set in a position capable of printing on the tape at the position of the platen roll.

As mentioned before, there has been a demand for downsizing of tape printers, and for that purpose, downsizing of the tape cartridge inserting section and the tape cartridge itself is inevitably required. The tape and ink ribbon supplying sections cannot be reduced in size so long as the tape and the ink ribbon housed in the cartridge are maintained in length thereof. Thus, the tape path and the ink ribbon path must be configured so as to realize the downsizing of the cartridge. Specifically, since the ink ribbon path circulates through the inside of the case such that it extends from the ink ribbon supply section to the ink ribbon recovery section passing through the printing position, it is important to make this path as compact as possible. To this end, in the conventional tape cartridge, the width of the ink ribbon path in the case is set as narrow as possible.

However, the provision of the narrow ribbon path causes the following problems inevitably. First, the ink ribbon is placed in the tape cartridge such that the ink ribbon in the form of a roll is inserted into the cartridge case and is pulled out therefrom to reach the ink ribbon recovery section via the ink ribbon path. Thus, if the ink ribbon path is narrow, the operation of placing the ink ribbon through the narrow path is difficult to carry out.

Second, the ink ribbon may stick on the side walls or other surfaces of the case defining the narrow ink ribbon path. More specifically, the ink ribbon tends to become loose when the tape cartridge is inserted into or released from the inserting section of the tape printer, especially when the tape cartridge is inserted therein. The loose ink ribbon sometimes comes into a position in which it contacts the surface of the narrow path. If the ink ribbon is left in this position, the ink of the ribbon may stick to the surface of the path. This occurrence will adversely affect the ink ribbon transfer operation during the following printing cycle, thereby causing defects including degradation of print quality.

Conventionally, in order to prevent the tape from becoming loose, a ring-shaped leaf spring is placed between the end of the ribbon roll and the cartridge case so as to restrict the rotation of the ribbon roll to a certain extent. However, where friction between the leaf spring and the cartridge case is high, the ink ribbon cannot be rolled out steadily at a constant speed. On the other hand, the rotational shaft of the ink ribbon roll is supported, at both of its ends, rotationally on bearing parts formed in the upper and lower casing parts, respectively. In case the friction of the bearing parts is high, the stable transfer of the ink ribbon cannot be obtained. In consideration of these defects, lubricant oil is supplied between the leaf spring and the case, and between the both ends of the rotational shaft of the ribbon roll and the bearing parts of the case sides.

The lubricant oil supplied on these portions may be caused to flow toward the ink ribbon, causing the ink ribbon to become soiled. In particular, if the size of the tape cartridge is reduced, the gap between the lubricant-oil coated portions and the ink ribbon is small, and therefore there is a great danger that the ink ribbon is made dirty by the oil. In order to prevent the ink ribbon from being made dirty, the amount of lubricant oil supplied or coated must be strictly controlled.

On the other hand, the tape cartridge case is a molded piece made of an electrically nonconductive synthetic resin material. Thus, static electricity tends to build up in the tape cartridge during use. When the buildup of the static electricity exceeds a certain amount, arcing occurs between the tape cartridge side and the printing head mechanism of the tape printer, which becomes a noise source adversely affecting peripheral electronic equipment. If the tape printer is reduced in size, the respective portions of the tape cartridge are so located that they are close to portions of the tape printer side. This may increase the occurrence of arcing between the tape cartridge and the tape printer. However, conventional tape printers are not provided with a means for preventing the buildup of static electricity in the tape cartridge.

SUMMARY OF THE INVENTION

Accordingly, a basic object of the present invention is directed to solve the problems associated with the downsizing of the tape cartridges of tape printer.

A more specific object of the present invention is to provide a tape cartridge for a tape printer in which an ink ribbon can easily be placed in an ink ribbon path of the tape cartridge.

Another object of the present invention is to provide a tape cartridge of a tape printer, which is able to prevent the ink ribbon from sticking on the cartridge case to cause an improper transfer of the ink ribbon.

Another object of the present invention is to provide a tape cartridge of a tape printer, in which the ink ribbon dose not become soiled by lubricant oil.

Yet another object of the present invention is to provide a tape cartridge of a tape printer, which is able to prevent static buildup that would cause arcing which would constitute a noise source.

On the other hand, the present invention is directed to solve the problems associated with downsizing of an ink ribbon cartridge which contains an ink ribbon and is used for a common printer.

That is, an object of the present invention is to provide an ink ribbon cartridge of a printer, in which the ink ribbon can easily be placed in an ink ribbon path of the ink ribbon cartridge.

Another object of the present invention is to provide a ribbon cartridge, which is able to prevent an ink ribbon from sticking on the cartridge case to cause an improper transfer of the ink ribbon.

Another object of the present invention is to provide an ink ribbon cartridge, in which the ink ribbon does not become soiled by the lubricant oil.

Yet another object of the present invention is to provide and ink ribbon cartridge, which is able to prevent static buildup causing an occurrence of arcing which becomes a noise source.

In order to achieve the above and other objects, according to the present invention, there is provided a tape and/or ribbon cartridge of a printer comprising a casing constituted by an upper casing part and a lower casing part, an ink ribbon supplying section positioned inside said casing, an ink ribbon recovery section positioned inside said casing, and an ink ribbon path extending from said ink ribbon supplying section to said ink ribbon recovery section through said printing position, in which the cartridge has first and second side wall portions facing with each other across a predetermined gap for defining a part of the ink ribbon path, an opening formed in the first side wall portion, and a shutter portion which is positioned to close the opening when the upper and lower casing parts are assembled with each other. The cartridge may further have a tape supplying section positioned inside the casing and a tape path for transferring a tape fed out from the tape supplying section through a printing position.

With this arrangement, since the first side wall portion defining the ink ribbon path in the casing is formed with the opening, the ink ribbon can easily be placed between the first and second side wall portions from the lateral direction through the opening. Thus, the ink ribbon can be inserted into the narrow path quite easily.

Further, in a tape cartridge according to the present invention, a side wall of the ink ribbon path located at the side facing the ink surface of the ink ribbon has such a non-flat surface facing the ink ribbon that a contact area thereof is less than that of a flat surface. An example of the non-flat surface is a wavy surface having alternating projections and depressions repeatedly with a constant pitch along the ink ribbon transfer direction.

By reducing the contact area between the surface of the side wall and the ink ribbon, the possibility of the ink ribbon becoming stuck on the side wall can be reduced. Even if the ink ribbon is stuck on the side wall, the area of the stuck portion of the ink ribbon is extremely small. Thus, a proper transfer of the ink ribbon can be maintained.

Next, according to the present invention, the ink ribbon supplying section of the tape printer comprises an ink ribbon roll and a core shaft of the roll, wherein both ends of the core shaft are supported rotationally by bearing portions formed on the lower and upper casing parts, and both ends of the core shaft and/or the bearing portions are made to have a low frictional surface coated with a dry lubricant such as polytetrafluoroethylene (PTFE). The low frictional surface may be obtained in such a manner that the core shaft of the ink ribbon roll or the casing is formed by using synthetic resin containing solid lubricant. For example, carbon-filled synthetic resin can be used.

Where the tape cartridge has a leaf spring interposed between the upper or lower casing part and the ink ribbon roll for providing a certain degree of resistance to rotation of the ink ribbon roll, it is preferable that one or both of the surfaces of the leaf spring and the casing contacting with each other are made to be the low frictional surface.

Since the bearing portions of the ink ribbon roll are made to be the low frictional surface without using lubricant oil, the ink ribbon does not become dirty due to the lubricant oil, while maintaining the proper rotation of the ink ribbon roll. Further, adjustment of the amount of lubricant coated is not so strict as that required when using a liquid lubricant. Where the cartridge casing is made from carbon-filled synthetic resin, it exhibits an electrical conductivity, preventing static buildup therein.

In another aspect of the present invention, there is provided a tape cartridge inserting mechanism of a tape printer, wherein a tape cartridge has an electrically conductive portion located at a position capable of being contacted with an inserting section of the tape printer for receiving the tape cartridge, while the inserting section of the tape printer has an electrically conductive portion located at a position capable of being contacted with the electrically conductive portion of the tape cartridge.

The electrically conductive portions may be made by using electrically conductive synthetic resin, metallic material, or the like. Alternatively, these portions can be made by coating an electrically conductive material on a prescribed surface, or a metal web may be deposited on a prescribed surface.

Examples of the synthetic resin material having an electrical conductivity include carbon-powder filled synthetic resin, metal-powder filled synthetic resin, and the like.

It is noted that an ink ribbon winding core shaft of the ink ribbon recovery section is the one in which the amount of static buildup tends to become extremely large. Therefore, it is preferable that the ribbon winding core shaft is made to be electrically conductive and an ink ribbon winding drive shaft of the tape printer which is inserted into the winding core shaft is also made to be electrically conductive, whereby the static buildup in the tape cartridge is discharged through these electrically conductive portions.

On other hand, the present invention is also applicable to ribbon cartridges having an ink ribbon therein in a manner similar to those of the above-mentioned tape cartridges. Likewise, the present invention can be applied to the ink ribbon cartridge inserting mechanism of a common printer in a manner similar to those of the above-mentioned tape cartridge inserting mechanism.

The above and other objects or advantages will be apparent for those skilled in the art from reading the following description with reference to the accompanying drawings.

DESCRIPTION OF THE PREFERRED EMBODIMENTS

Although the present invention will be described in connection with a preferred embodiment, it is not intended that the present invention be limited to that embodiment. On the contrary, the invention is intended to cover all alternatives, modifications, and equivalents as may be included within the scope or spirit of the present invention as defined by the attached claims.

Overall Structure

Figure 1:
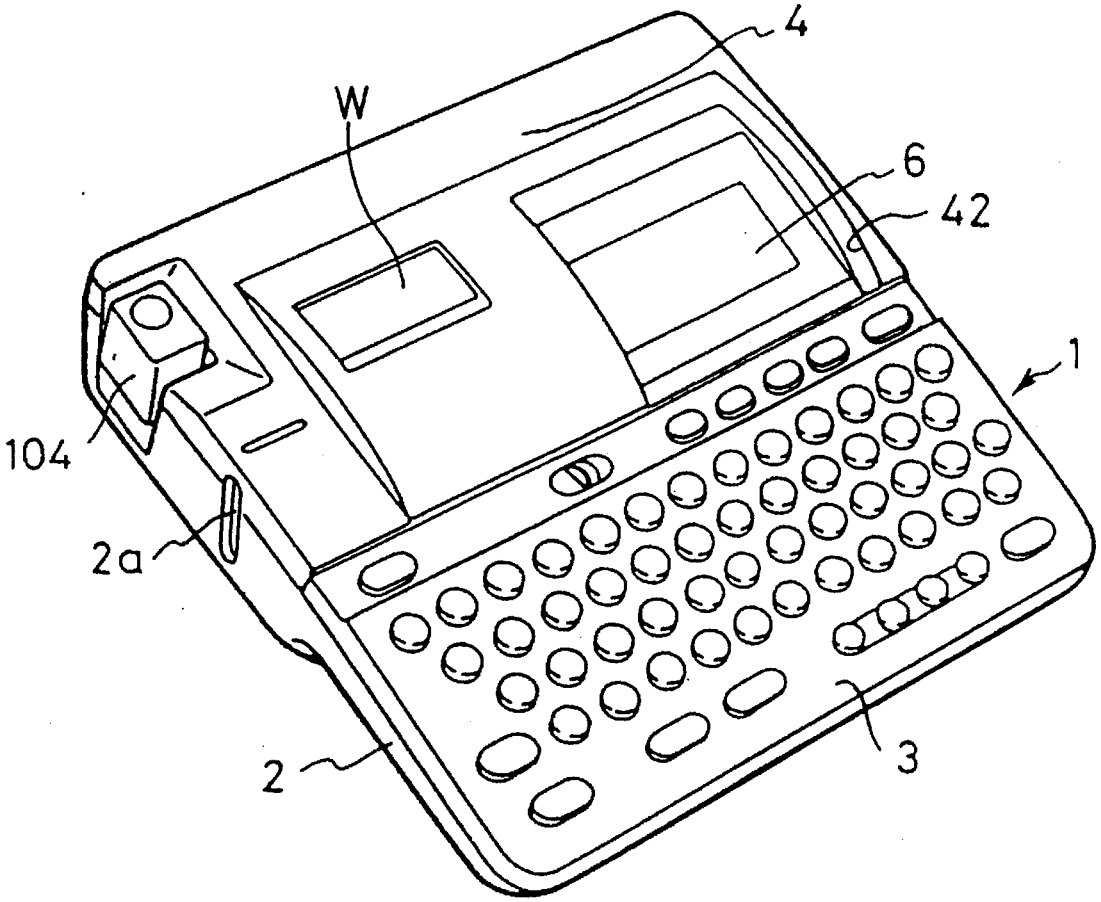
FIG. 1 is a perspective view showing the external appearance of an example of a tape printer according to the present invention.
Figure 2:
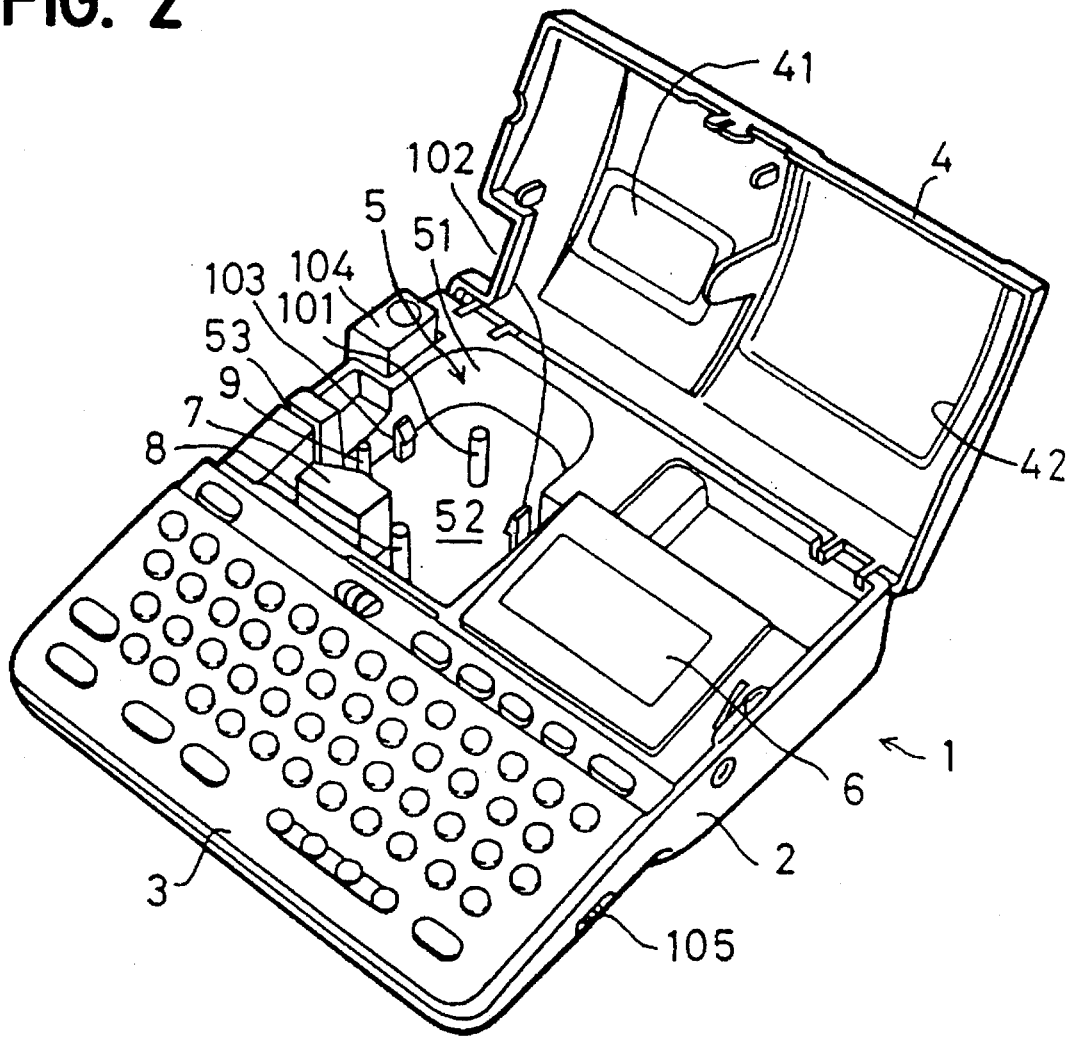
FIG. 2 is a perspective view of the tape printer of FIG. 1, with an upper cover opened.

Referring now to FIG. 1, an exemplary tape printer 1 according to the invention is thin and rectangular in shape as a whole. The tape printer 1 has a main casing 2 which is formed with an operational panel 3 on the front-side half portion of its upper surface. The operational panel 3 has a plurality of input keys arranged thereon. The main casing 2 has a main cover 4 at the rear half portion of its surface which can be opened and closed about an axis at the rear end thereof. As shown in FIG. 2, a tape cartridge inserting section 5 and a display panel 6 for displaying a variety of information are provided under the main cover 4. The main cover 4 is formed therein with a window W for confirming insertion of a tape cartridge into the tape cartridge inserting section 5 and an opening 42 through which the display panel 6 is exposed. It is noted that the basic constitution of the tape printer of the present example is the same as that of the tape printer disclosed in U.S. patent application Ser. No. 08/132,556 filed on Oct. 6, 1993, and assigned to the same assignee of the present invention, which application is incorporated herein by reference.

Tape Cartridge Inserting Section

The tape cartridge inserting section 5 is constituted to receive the tape cartridge 10 (FIG. 3 to be described below) from above and has an inner circumferential side wall 51 and a bottom wall 52. The bottom wall 52 is provided with a print unit 7 of the thermal transfer type, an ink ribbon winding drive shaft 8 and a platen roll drive shaft 9 which project therefrom vertically. The bottom wall 52 is also provided with a positioning vertical shaft 101 and a pair of holding latches 102, 103 for maintaining the inserted tape cartridge in the inserting section 5, these shaft and latches projecting from the bottom wall. The inner circumferential side wall 51 is formed with a slit 53 for exiting of the tape which communicates with a tape exit slot 2*a* formed on the side of the main casing 2. A tape cutter (not shown) is provided in a passage between the slit 53 and the slot 2*a*, and is mechanically linked with a cutter button 104 placed near the slot 2*a*. The button 104 is pressed to drive the cutter so that the tape exiting via the slot 2*a* through the slit 53 is cut.

The tape printer 1 has control circuits for controllably driving the tape printer and a drive-power transfer mechanism for transferring drive power from a built-in drive motor to respective driven mechanisms which are assembled under the bottom wall 52 of the inserting section 5. These elements are described in the above referenced U.S. patent application Ser. No. 08/132.556 and are also incorporated herein by reference. The platen roll drive shaft 9 and the ink ribbon winding drive shaft 8 are driven through the drive-power transfer mechanism.

In the present example, the bottom wall 52 of the inserting section 5 is made of carbon-filled synthetic resin material and therefore has an electrical conductivity.

Tape Cartridge

Figure 3:
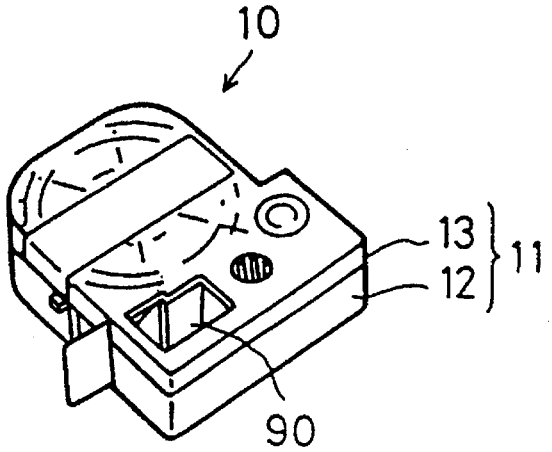
FIG. 3 is a perspective view of a tape cartridge removed from the tape printer of FIG. 1.
Figure 4A:
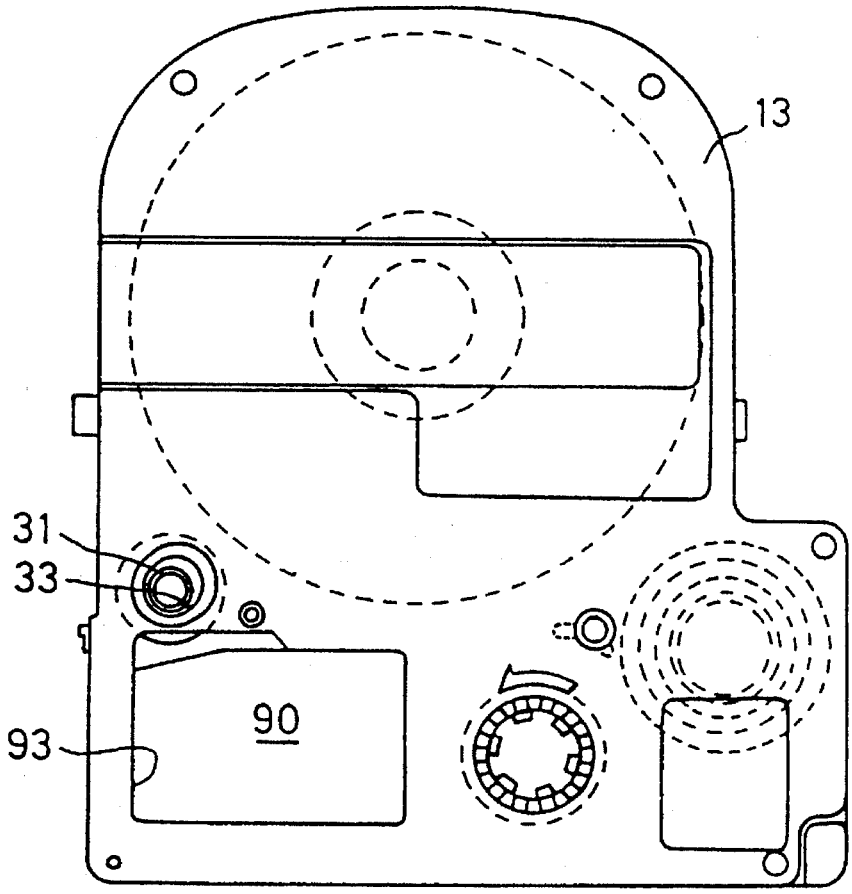
FIG. 4A is a plan view of a tape cartridge.
Figure 4C:
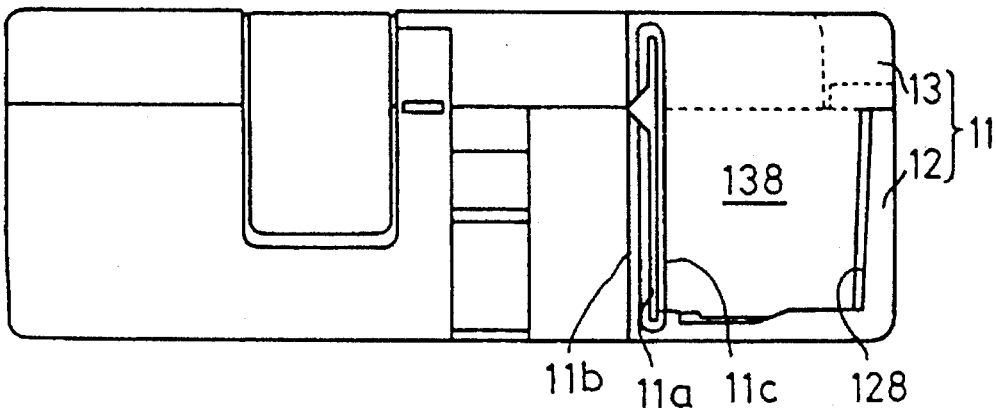
FIG. 4C is a side view of the tape cartridge of FIG. 4A, viewed from the tape exit side thereof.
Figure 4B:
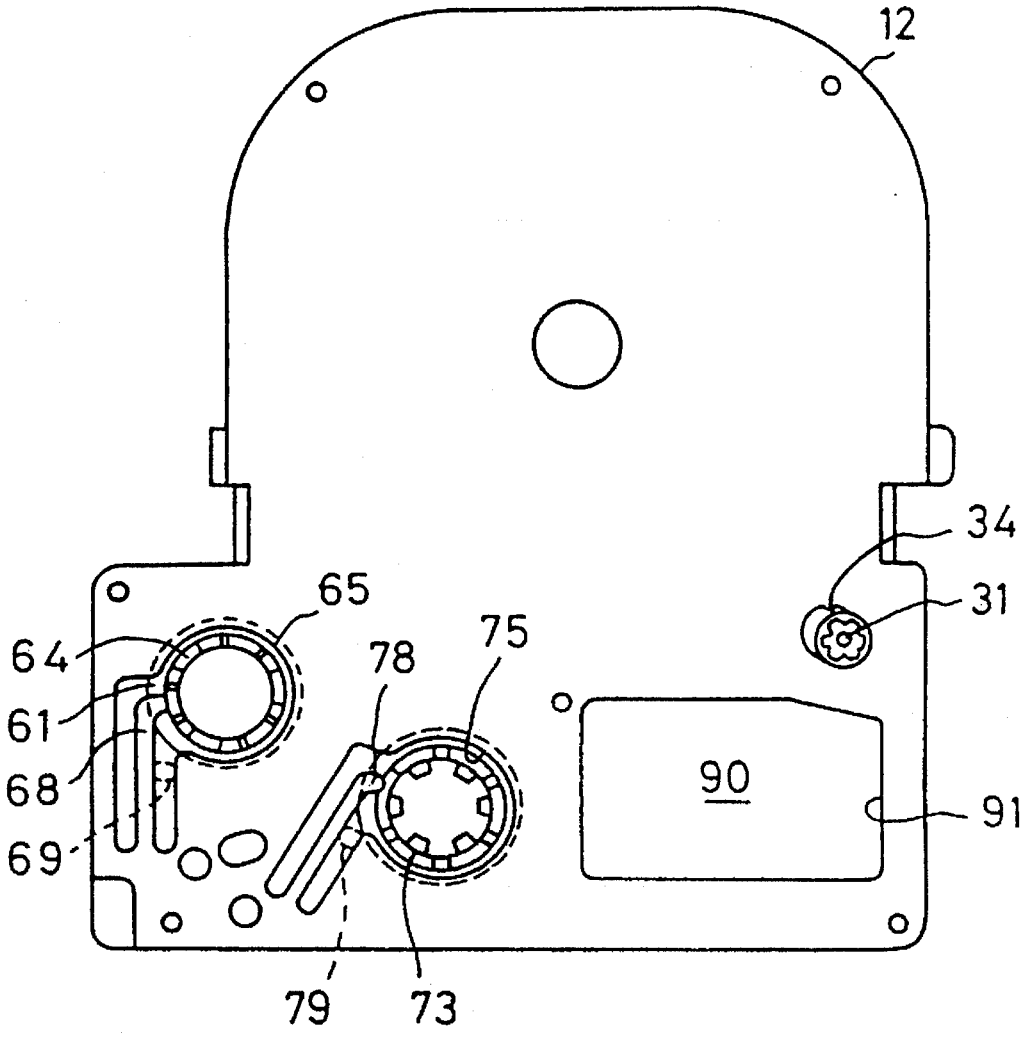
FIG. 4B is a rear-side view of the tape cartridge of FIG. 4A.
Figure 5A:
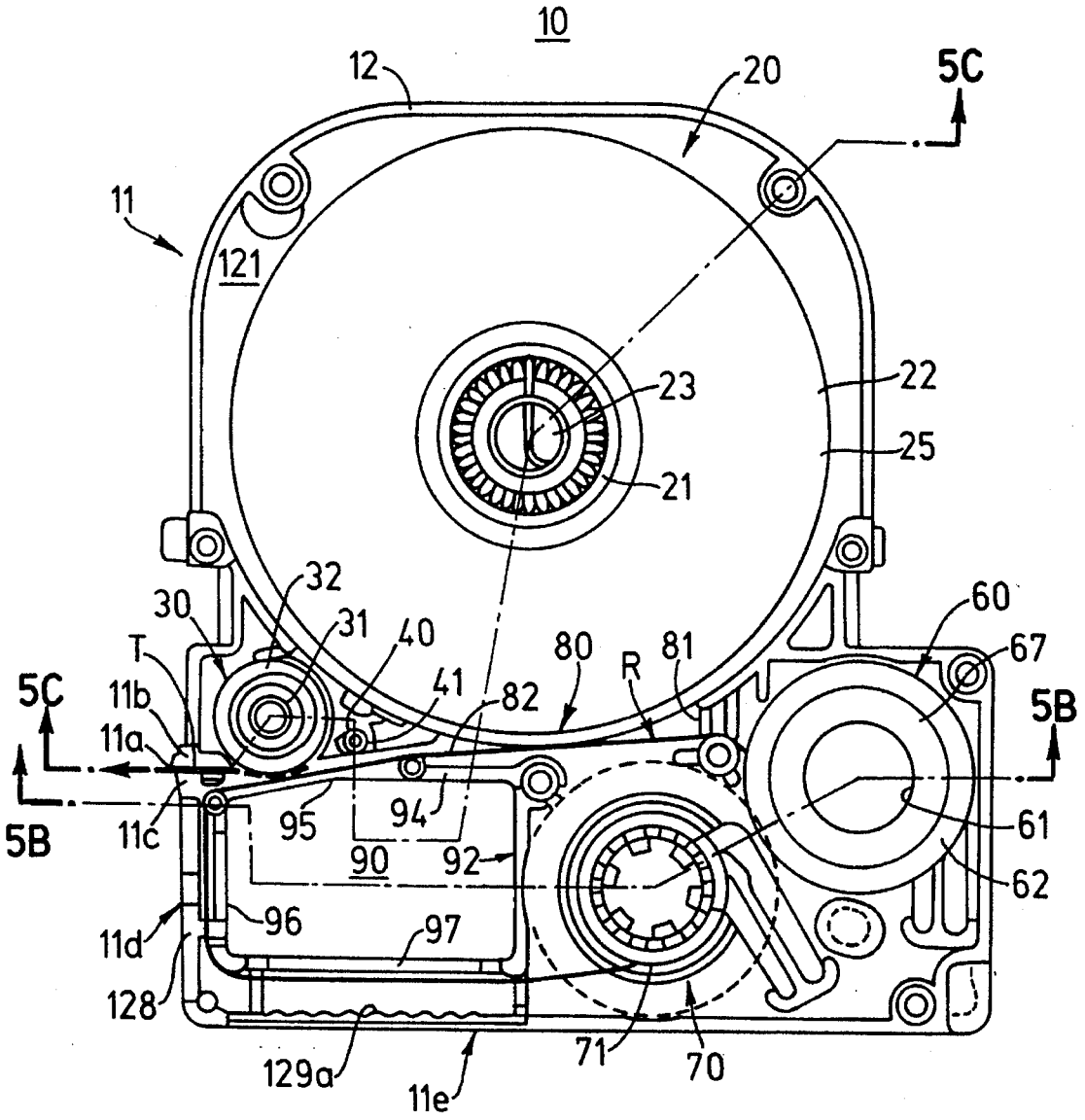
FIG. 5A is a plan view of the tape cartridge of FIG. 4A, in a condition that an upper casing part is removed.
Figure 5B:
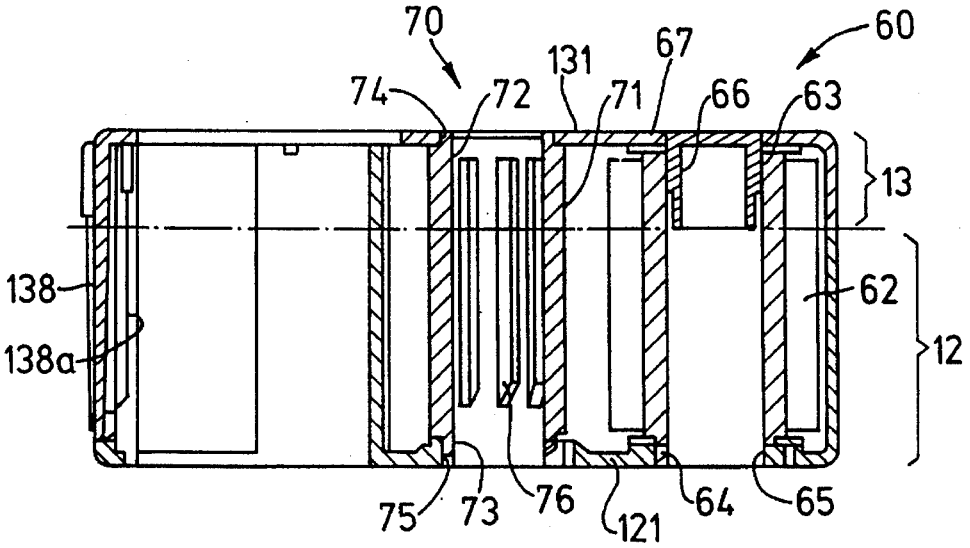
FIG. 5B is a sectional view of the tape cartridge of FIG. 4A, taken along line 5B—5B of FIG. 5A.
Figure 5C:
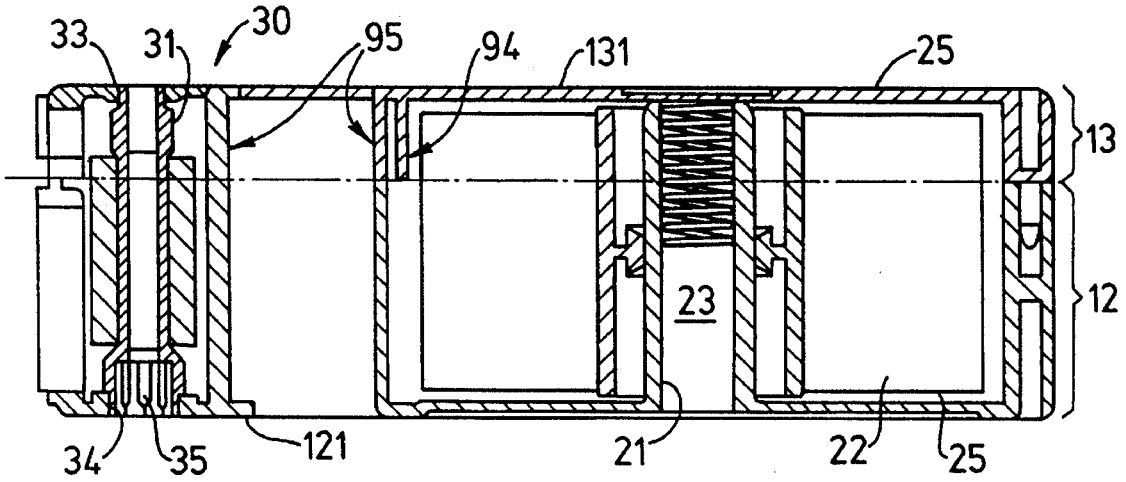
FIG. 5C is a sectional view of the tape cartridge of FIG. 4A, taken along line 5C—5C of FIG. 5A.

The tape cartridge will now be described with reference to FIGS. 3 to 5, in which FIG. 3 is a perspective view of the tape cartridge 10, FIGS. 4A, 4B and 4C are a plan view, a rear view, and a side view, respectively, while FIG. 5A is a plan view showing the inner structure of the tape cartridge with an upper casing part thereof removed, and FIGS. 5B and 5C are sectional views taken along lines 5B—5B and 5C—5C, respectively, of FIG. 5A.

The tape cartridge 10 has a casing 11 constituted by assembling a lower casing part 12 and an upper casing part 13 along the thickness direction thereof. The lower casing part 12 comes into contact with the bottom wall 52 of the tape printer when the tape cartridge 10 is inserted into the inserting section 5. In the present example, the lower casing part 12 is made from carbon-filled synthetic resin material and therefore has an electrical conductivity. The upper casing part can also be made from the same material as that of the lower casing part so that it has an electrical conductivity.

As can be seen from FIG. 5A, in the casing 11 of the tape cartridge 10, there are provided a tape supplying section 20, and a tape path 40 for transferring a tape T from the tape supplying section 20 through a platen roll 30 defining a printing section and a tape exit 11*a* formed on the casing side surface. In this drawing, the tape path 40 is denoted by a dashed line representing the tape T. The tape cartridge 10 is also provided therein with an ink ribbon supplying section 60, an ink ribbon recovery section 70, and an ink ribbon path 80 extending from the ink ribbon supplying section 60 to the ink ribbon recovery section 70 through the platen roll 30. In FIG. 5A, the path 80 is denoted by a thick line representing an ink ribbon R. In addition, in the vicinity of the platen roll 30, a rectangular through hole is formed to extend along the thickness direction of the casing 11 so as to define a receiving section 90 for the print unit 7 of the tape printer 1.

The tape supplying section 20 has a hollow tape core 21 projecting vertically from the bottom wall 121 of the lower casing part 12, and a tape roll 22 formed by winding the long tape T around the tape core 21. The tape core 21 has a center hollow portion 23 into which the vertical shaft 101 formed on the bottom wall 52 of the inserting section 5 can be fitted from the lower end side. The tape roll 22 has circular thin films 25, adhered on the upper and lower axial ends thereof, respectively. Since both edges, in the width direction, of the tape T are slightly adhered on these films, the tape roll 22 is prevented from becoming loose by the unwinding operation of the tape T.

The tape T of the present example is treated so that ink can be deposited sufficiently on the printing surface thereof. The tape T is provided on its rear surface with an adhesive layer covered by a release paper.

The tape path 40 passes through a tape guide pin 41 projecting vertically from the bottom wall 121 of the lower casing part 12, the platen roll 30 and the tape exit 11*a* to reach outside of the casing. The tape exit 11*a* is defined by a pair of guide walls 11*b* and 11*c* facing each other across a predetermined gap placed along the transfer direction of the tape T.

The platen roll 30 is positioned adjacent to the receiving section 90 for the print unit 7, and is constituted by a hollow shaft 31 and a hollow platen rubber roll 32. As can be seen in FIG. 5C, the hollow shaft 31 is formed at both of its ends with journals of reduced diameter which are supported rotatably by bearing holes 33, 34 formed in the upper and lower casing parts, respectively. The hollow portion of the hollow shaft 31 is designed to receive, via its lower end opening, the platen roller drive shaft 9 projecting from the bottom wall 52 of the inserting section 5. The hollow shaft 31 has an inner circumferential surface which is formed with engaging projections 35 uniformly, or equiangularly, spaced around the axis of shaft 31. These projections 35 are designed to engage with the platen roll drive shaft 9 so as to transfer drive power from the shaft 9 to the hollow shaft 31.

Next, with reference to FIGS. 5A and 5B, the ink ribbon supplying section 60 comprises a hollow bobbin 61 and an ink ribbon 62(R) wound around the bobbin 61. The bobbin 61 is formed with a lower end portion 64 the diameter of which is made smaller than the other portion of the bobbin. The lower casing part 12 is formed with a hole 65 into which the lower end portion 64 of the bobbin 61 can be inserted. The upper casing part 13 has a top wall 131 formed with a circular projection 66 insertable into the hollow portion of the upper end 63 of the bobbin 61. Thus, the bobbin 61 is supported rotatably between the upper and lower casing parts 12 and 13 in a manner that the lower end portion 64 thereof is inserted into the hole 65 and the circular projection 66 is inserted into the upper end portion 63 thereof.

A ring shaped leaf spring 67 is placed around the circular projection 66 formed on the top wall 131 of the upper casing part 13, whereby the end of the ink ribbon 62 is applied with a certain degree of resistance to rotation for controlling unwinding operation of the ink ribbon.

In addition, in the present example, a PTFE coating is applied to the upper and lower end portions 63, 64 of the bobbin 61 to create low frictional surfaces for the purpose of assuring smooth rotation of the bobbin 61. Likewise, PTFE coatings are also applied on the outer circumferential surface of the circular projection 66 of the upper casing part 13 and an inner circumferential surface of the hole 65 of the lower casing part 12 so as to form low frictional surfaces on them. Furthermore, a PTFE coating is also applied on the surface of the top wall contacting the surface of the leaf spring 67 so as to form a low frictional surface.

The ink ribbon recovery section 70 has a hollow shaft, or bobbin, 71 which has small outer diameter portions at upper and lower ends 72 and 73. The top wall 131 of the upper casing part and the bottom wall 121 of the lower casing part have holes 74 and 75, respectively, formed therein, into which holes the upper end 72 and the lower end 73 are insertable. The bobbin 71 is supported rotationally between the upper and lower casing parts with the upper and lower ends being inserted into the corresponding holes 74 and 75. The inner circumferential surface of the bobbin 71 has projections 76 formed thereon, projections 76 extending inwardly and being spaced uniformly, or equiangularly, around the axis of shaft 71. On the other hand, the ribbon winding drive shaft 8 which projects vertically from the bottom wall 52 of the inserting section 5, is insertable into the hollow portion of the bobbin 71 and, when inserted, engaging projections (not shown) extending outwardly from the outer circumferential surface of the shaft 8 engage with the projections 76 of the bobbin 71. With engagement of these projections, the bobbin 71 is driven to rotate by the ribbon winding drive shaft 8.

As can be seen from FIGS. 4B and 5A, the bobbins 61 and 71 of the ink ribbon supplying and recovery sections have lower ends 64 and 73 formed with grooves that are spaced apart equiangularly in the circumferential direction. At the side of the lower casing part 12, engaging pieces 68 and 78 are formed so that they project slightly inwardly from the inner circumferential surfaces of the holes 65 and 75 for receiving the above-mentioned lower ends 64 and 73. These engaging pieces 68, 78 engage with the circumferential grooves of the bobbin lower ends 64 and 73, respectively, when the tape cartridge 10 is not inserted into the inserting section 5 of the tape printer so that the bobbins 61 and 71 are prevented from rotating. Thus, the ink ribbon does not become loose by undesirable rotation of the bobbins 61 and 71.

In an inserted condition of the tape cartridge 10, these engaging pieces 68 and 78 are forced to move by projections 69 and 79 formed on the surface of the bottom wall 52 of the inserting section 5 (shown by broken lines in FIG. 4B) so that the engaging pieces 68 and 78 are removed from circumferential grooves of the bobbin lower ends 64 and 73. Therefore, the bobbins is set to be rotatable.

The ink ribbon path from the ink ribbon supplying section 60 to the ink ribbon recovery section 70 will now be described. As shown in FIG. 5A, the supplying section 60 and the recovery section 70 are arranged at the same side of the receiving section 90 for the print unit 7 in the casing. The supplying section 60 is provided in the vicinity of its ribbon feed position with a ribbon guiding roller 81 which is integrally formed on the bottom wall 121 of the lower casing part. The receiving section 90 is constituted by a rectangular opening 91 formed in the lower casing part 12, a partition wall 92 extending vertically in the thickness direction of the casing from the circumferential edge of the opening 91, and a rectangular opening 93 formed in the upper casing part 13 (FIG. 4A). The partition wall 92 has a wall portion 94 facing the platen roller 30, this wall portion 94 having a cutout 95 formed therein. A ribbon guiding pin 82 is formed integrally on one side edge of the cutout 95. The ink ribbon R fed from the supplying section 60 is guided by the guiding roller 81 and the guiding pin 82 to pass through the platen roller 30 in a manner that the ink layer of the ink ribbon R faces the platen roller 30. The ink ribbon R comes into contact with the tape T at the location of the platen roller 30 where a printing operation onto the tape T is carried out by the printing head of the thermal transfer type of the print unit 7.

The partition wall 92 also has a wall portion 96 facing an outer circumferential wall 11*d* formed with the tape exit 11*a*. This wall portion 96 is formed to be parallel to the other circumferential wall 11*d* with a narrow gap therebetween and has a rectangular cutout at its center part. Further, the partition wall 92 has a wall portion 97 continuing from the wall portion 96 and extending in an orthogonal direction thereto. The wall portion 97 is also placed parallel to an outer circumferential wall 11*e* of the casing across a narrow gap and has a rectangular cutout at its center part. The ink ribbon R, after moving past the platen roll 30, is moved away from the tape T and is transferred toward the ink ribbon recovery section 70 guided by these wall sections 96 and 97.

According to the present example, the outer circumferential wall 11*d* facing to the wall portion 96 is constituted as follows. With reference to FIGS. 5A and 4C, an opening 128 is formed in the portion of the outer circumferential wall 11*d* which is part of the outer circumferential wall of the lower casing part 12. This opening 128 is formed by cutting the circumferential wall of the lower casing part 12 from the top so that opening 128 has a substantially rectangular outline. The portion of the outer circumferential wall 11*d* in the upper casing part 13 has a projection 138 constituting a shutter wall which is designed to fit exactly into and close the opening 128 when the upper casing part 13 is assembled to the lower casing part 12. The shutter wall 138 of the present example is formed integrally at its side edge with a guide plate 11*c* defining the tape exit 11*a*.

The inner surface 138 *a* of the shutter wall 138 (FIG. 5B) is a wavy, or corrugated, surface on which projections alternate with depressions with a uniform pitch along the ribbon transfer direction. The outer circumferential wall 11*e* of the casing which faces the wall portion 97 is constituted by an outer wall portion 129 of the lower casing part 12 and a corresponding outer wall portion (not shown) of the upper casing part 13. Inner surface 129 *a* of the outer wall portion 129 and an inner surface the corresponding outer wall portion of the upper casing part 13 are also configured to form a common wavy surface like the inner surface 138 *a* of the shutter wall 138.

In the thus constituted tape cartridge 10 of the present example, the ink ribbon R pulled out from the rolled ink ribbon 62 is arranged to pass along the ink ribbon path and is wound around the winding bobbin 71 of the ink ribbon recovery section 70 as shown in the heavy line in FIG. 5A. Thus, the ink ribbon R must be arranged so as to pass through the narrow portions of the path, for example, between the outer circumferential wall 11*d* and the inner wall portion 96. Conventionally, installation of the ink ribbon is carried out by removing the upper casing part and then inserting the ink ribbon R into the narrow path from above. In contrast, according to the present example, since the outer circumferential wall 11*d* is formed with the opening 128, an outer side surface of the wall portion 96 is in an open condition when the upper casing part 13 is removed. Hence, the ink ribbon R can easily be positioned in this portion. After the ink ribbon is positioned, the upper casing part 13 is assembled to the lower casing part 12, whereby the opening 128 is closed by the shutter wall 138 of the upper casing part 13, so that the narrow path defined by the inner side surface of the shutter wall 138 and the wall portion 96 is established with the ink ribbon being inserted therebetween.

As mention above, according to the present example, the narrow path of the ink ribbon is formed with the opening via which the ink ribbon is accessible laterally from the outside, and the opening is closed by assembling the upper casing part to the lower casing part. Therefore, the placement of the ink ribbon in the narrow path can be carried out easily, so that the placement of the ink ribbon in the casing can be carried out effectively. In other words, the ink ribbon path can be reduced in size without degrading the ease of ink ribbon placement in the casing, and therefore a downsizing of the tape cartridge can easily be realized.

When the tape printer 1 is to be used, the cover 4 is opened so that the tape cartridge 10 is inserted into the inserting section 5. After insertion of the tape cartridge 10, the cover 4 is closed. When the tape cartridge 10 is inserted into the inserting section 5 from above, the print unit 7 projecting vertically from the bottom wall 52 is inserted into the receiving section 90 of the tape cartridge, whereby the printing head 7a of the thermal transfer type of the print unit 7 is positioned to face the outer circumferential surface of the platen roll 30. At the same time, the platen roller drive shaft 9 and the ink ribbon winding drive shaft 8 am inserted into the hollow shaft 31 and the ribbon winding bobbin 71 to form mechanical engagements therebetween, respectively. Moreover, the latched 102, 103 projecting from the bottom wall 52 of the inserting section 5 come into engagement with the corresponding outer side surfaces of the tape cartridge casing 11, whereby the tape cartridge 10 is prevented from being released from the inserting section 5.

After insertion of the tape cartridge 10, a power switch 105 (FIG. 2) arranged on the main casing of the tape printer 1 is operated to be ON. After the tape printer is automatically initialized to be placed in a state capable of receiving input, the keys on the operational panel 3 are selectively operated to input a series of desired letters. Thereafter, with the key-in of the printing instruction, the platen roll drive shaft 9 and the ink ribbon winding drive shaft 8 are driven to rotate, so that the platen roller 30 and the ribbon winding bobbin 71 are driven to rotate, whereby transfer of the tape T and the ink ribbon R re commenced. In synchronism with the transfer of the tape T and the ink ribbon R, the printing head of the print unit 7 is driven to carry out the printing operation on the tape T as the tape T moves past the platen roller 30.

The tape T, after having been printed, is transferred through the tape exit 11*a* of the outer casing of the tape cartridge 10 and the slot 53 of the tape printer side, and is moved out from the tape exit 2*a*. After the printing operation of inputted characters is completed, the transfer of the tape T and of the ink ribbon R are stopped.

Then the cutter button 104 is pressed to operate the cutter which is mechanically linked to the button 104 to thereby cut the tape at the position in the slot 53. Thus, a tape piece (label) of a prescribed length having a desired printed characters is obtained. As mentioned before, the release paper is removed from the tape piece obtained to expose the adhesive layer on the back side of the tape piece, so that it can be adhered to a desired surface.

After the printing operation is finished, the power to the tape printer is turned OFF by operating button 105. The tape cartridge 10 is often left in the inserting section 5 as it is. In this condition, the ink ribbon T is left arranged in the path 80. Where the ink ribbon path 80 is narrow, the ink layer of the ink ribbon R tends to come into contact with the side wall surface defining a part of the ink ribbon path. This could cause the ink ribbon R to become stuck or adhered on the side wall surface. If movement of the ink ribbon R is restarted under the condition that it has become stuck to the side wall surface, there is a possibility that the ink ribbon will not be properly or stably advanced.

According to the present example, however, the surfaces of the side walls to which the ink ribbon may be stuck are given a wavy form. That is, the shutter wall 138 of the upper casing part which defines the outer circumferential wall 11*d* has the inner wavy surface. Further, the inner surface 129 *a* of the lower casing part and the corresponding inner surface of the upper casing part, which define the outer circumferential wall 11*e* of the casing 11, are also made given a wavy form. With these wavy surfaces, the contact area of the ink ribbon to these surfaces can be reduced compared with that of a flat surface. Thus, the ink ribbon can be prevented from sticking on the surfaces of the walls. Even if the ink ribbon becomes stuck on the wavy surfaces, the area of the stuck portions of the ink ribbon to the wavy surfaces is so small that the adhesive force will have no effect. Thus, any sticking of the ink ribbon will not adversely affect the proper advance of the ink ribbon.

The wall surfaces to which the ink ribbon may be stuck or adhered also can be formed such that they have a plurality of hemispheric projections instead of the wavy surface. In either case, these surfaces may be made to be non-flat so that they have an area of contact with the ink ribbon which is less than that of a flat surface.

Next, in the present invention, the upper and lower ends 62, 63 of the bobbin 61 around which the ink ribbon is wound are provided with PTFE coatings to have a low frictional surface or lubricant surface. Likewise, the circular projection 66 of the upper casing part and the hole 65 of the lower casing part for supporting both ends 62, 63 of the bobbin 61 are also provided with PTFE coatings to have low frictional surfaces.

Conventionally, these bearing portions are coated with lubricant oil to impart lubricating properties thereto. Where the lubricant oil is coated on these bearing portions, if the amount of lubricant oil coated is excessive or the like, the coated lubricant oil may flow to other regions where the lubricant oil is not required. The ink ribbon is then sometimes made dirty by the lubricant oil. According to the present invention, since the PTFE coating is applied to the bearing portions instead of the lubricant oil, this problem will not occur.

It goes without saying that the bearing portions can by made to be low frictional surfaces by applying surface treatments other than the PTFE coating application. Further, the bearing portions can be made by solid lubricant filled synthetic resin materials. Furthermore, in addition to the above bearing portions, the leaf spring 66 may be surface treated to have a low frictional surface.

On the other hand, when printing operations as mentioned above are continued, due to friction between moving parts and the like, static buildup can occur in the tape cartridge 10. In the present example, the lower casing part and the bottom wall 52 of the inserting section 5 are given an electrical conductivity. Hence, the static electricity generated in the tape cartridge 10 is discharged toward the tape printer side through the electrically conductive portions. This prevents a large amount of static buildup in the tape cartridge casing and the occurrence of arcing which would adversely affect peripheral electronic devices.

Among others, the ribbon winding bobbin 71 in the tape cartridge 10 is one in which the static buildup is distinct. Thus, this portion is made from a material having an electrical conductivity and the portion of the tape printer side contacting the bobbin 71, that is the ink ribbon winding drive shaft 8, is also made to have an electrical conductivity, whereby the static buildup in the tape cartridge can be prevented efficiently. In order to provide electrical conductivity, molding materials having electrically conductive metal particles or the like mixed therein instead of carbon may be used to form the casing or other parts of the tape cartridge. Alternatively, an electrically conductive metallic material is used to form a part of the tape cartridge. Further, an electrically conductive material may be coated on portions for which the electrical conductivity is required, or a metal web may be plated thereon.

It is to be noted that the above-mentioned tape cartridge is an example of the present invention, that is the arrangement or structure of the above-described tape cartridge is merely an example of the present invention. It is understood, of course, that the present invention can by applied to tape cartridges of other forms or structures in the same manner as for the above-mentioned tape cartridge. Moreover, the present invention can be similarly applied to a ribbon cartridge for use in a conventional printer.

What is claimed is:

1. A tape cartridge for use in a tape printer, said tape cartridge comprising: a casing constituted by an upper casing part and a lower casing part; a tape supplying section positioned inside said casing; means defining a tape path for transferring a tape fed from said tape supplying section through a printing position; an ink ribbon supplying section positioned inside said casing; an ink ribbon recovery section positioned inside said casing; and means defining an ink ribbon path extending from said ink ribbon supplying section and through the printing position to said ink ribbon recovery section, wherein said casing has first and second side wall portions facing one another across a predetermined gap, which gap defines a part of said ink ribbon path, said first side wall portion being provided with an opening, and said casing further has a shutter portion which is positioned to close said opening when said upper and lower casing parts are assembled with each other.

2. A tape cartridge according to claim 1, wherein said ink ribbon supplying section, said ink ribbon recovery section and said means defining an ink ribbon path are provided for retaining an ink ribbon having an ink-bearing surface, and one of said side wall portions has a non-flat surface facing the ink-bearing surface when the ink ribbon is in the ink ribbon path, said non-flat surface being formed to contact a smaller area of the ink-bearing surface than would a flat surface.

3. A tape cartridge according to claim 2, wherein said ink ribbon supplying section comprises an ink ribbon roll and a core shaft for said roll, said core shaft having two axial ends, each of said lower and upper casing parts has a respective bearing portion for rotatably supporting a respective end of said core shaft, and a dry lubricant interposed between each said core shaft end and a respective bearing portion to create a low coefficient of friction between said core shaft ends and said bearing portions.

4. A tape cartridge according to claim 3, wherein said casing has an electrically conductive portion which is located to come into contact with the tape printer.

5. A tape cartridge for use in a tape printer, said tape cartridge comprising: a casing constituted by an upper casing part and a lower casing part; a tape supplying section positioned inside said casing; means defining a tape path for transferring a tape fed from said tape supplying section through a printing position; an ink ribbon supplying section positioned inside said casing; an ink ribbon recovery section positioned inside said casing; means defining an ink ribbon path extending from said ink ribbon supplying section and through the printing position to said ink ribbon recovery section, wherein said casing forms an ink ribbon path for retaining an ink ribbon having an ink-bearing surface, said casing has a side wall defining a part of said ink ribbon path, and said side wall has a non-flat interior surface facing, and contactable by, the ink-bearing surface when the ink ribbon is in the ink ribbon path, said non-flat surface being formed to contact a smaller area of the ink-bearing surface than would a flat surface.

6. A tape cartridge for use in a tape printer, said tape cartridge comprising: a casing constituted by an upper casing part and a lower casing part; a tape supplying section positioned inside said casing; means defining a tape path for transferring a tape fed from said tape supplying section through a printing position; an ink ribbon supplying section positioned inside said casing; an ink ribbon recovery section positioned inside said casing; means defining an ink ribbon path extending from said ink ribbon supplying section and through the printing position to said ink ribbon recovery section, wherein said casing forms an ink ribbon path for retaining an ink ribbon having an ink-bearing surface, said casing has a side wall defining a part of said ink ribbon path, and said side wall has a non-flat surface facing, and contactable by, the ink-bearing surface when the ink ribbon is in the ink ribbon path, said non-flat surface being formed to contact a smaller area of the ink-bearing surface than would a flat surface and said non-flat surface of said side wall is a wavy surface having wave-shaped projections which alternate with depressions with a constant pitch along an ink ribbon transfer direction.

7. A tape cartridge according to claim 6, wherein said ink ribbon supplying section comprises an ink ribbon roll and a core shaft for said roll, said core shaft having two axial ends, each of said lower and upper casing parts has a respective bearing portion for rotatably supporting a respective end of said core shaft, and a dry lubricant interposed between each said core shaft end and a respective bearing portion to create a low coefficient of friction between said core shaft ends and said bearing portions.

8. A tape cartridge according to claim 7, wherein said casing has an electrically conductive portion which is located to come into contact with the tape printer.

9. A tape printer having a tape cartridge inserting section, in combination with a tape cartridge releasably insertable in said inserting section, wherein:

said tape cartridge has a first electrically conductive portion located to come into contact with said inserting section when said tape cartridge is inserted into said inserting section, and said inserting section of said tape printer has a second electrically conductive portion located to come into contact with said first electrically conductive portion when said tape cartridge is inserted into said inserting section, wherein; each conductive portion is made of a material in which an electrically conductive material is mixed; said tape cartridge comprises an ink ribbon recovery section having a winding core shaft for winding an ink ribbon; said first electrically conductive portion is constituted by said winding core shaft; said printer comprises a drive shaft insertable into said winding core shaft, for driving said winding core shaft, when said tape cartridge is inserted into said inserting section; and said second electrically conductive portion is constituted by said drive shaft.

10. A ribbon cartridge for use in a printer, said ribbon cartridge comprising: a casing constituted by an upper casing part and a lower casing part; an ink ribbon supplying section positioned inside said casing; an ink ribbon recovery section positioned inside said casing; and means defining an ink ribbon path extending from said ink ribbon supplying section and through a printing position to said ink ribbon recovery section, wherein said casing has first and second side wall portions facing one another across a predetermined gap, which gap defines a part of said ink ribbon path, said first side wall portion being provided with an opening, and said casing further has a shutter portion which is positioned to close said opening when said upper and lower casing parts are assembled with each other.

11. A ribbon cartridge according to claim 10, wherein said ink ribbon supplying section, said ink ribbon recovery section and said means defining an ink ribbon path are provided for retaining an ink ribbon having an ink-bearing surface, and one of said side wall portions has a non-flat surface facing the ink-bearing surface when the ink ribbon is in the ink ribbon path, said non-flat surface being formed to contact a smaller area of the ink-bearing surface than would a flat surface.

12. A ribbon cartridge according to claim 11, wherein said ink ribbon supplying section comprises an ink ribbon roll and a core shaft for said roll, said core shaft having two axial ends, each of said lower and upper casing parts has a respective bearing portion for rotatably supporting a respective end of said core shaft, and a dry lubricant interposed between each said core shaft end and a respective bearing portion to create a low coefficient of friction between said core shaft ends and said bearing portions.

13. A ribbon cartridge according to claim 12, wherein said casing has an electrically conductive portion which is located to come into contact with the tape printer.

* * * * *